United States Patent [19]

Ohno et al.

[11] Patent Number: 4,578,345

[45] Date of Patent: Mar. 25, 1986

[54] METHOD FOR PROCESSING COLOR PHOTOGRAPHIC LIGHT-SENSITIVE MATERIAL

[75] Inventors: Shigeru Ohno; Shinzo Kishimoto; Akihiko Ikegawa; Morio Yagihara, all of Kanagawa, Japan

[73] Assignee: Fuji Photo Film Co., Ltd., Kanagawa, Japan

[21] Appl. No.: 664,176

[22] Filed: Oct. 24, 1984

[30] Foreign Application Priority Data

Oct. 31, 1983 [JP] Japan ..... 58-204591

[51] Int. Cl.[4] ..... G03C 7/00

[52] U.S. Cl. ..... 430/393; 430/428; 430/429; 430/430; 430/943

[58] Field of Search ..... 430/393, 430, 428, 429, 430/943

[56] References Cited

U.S. PATENT DOCUMENTS

| | | | |
|---|---|---|---|
| 3,232,936 | 2/1966 | Reynolds | 430/428 |
| 3,772,020 | 11/1973 | Smith | 430/393 |
| 3,779,757 | 12/1973 | Hofman et al. | 430/233 |
| 4,292,401 | 9/1981 | Itoh et al. | 430/393 |
| 4,458,010 | 7/1984 | Yamamuro et al. | 430/393 |

*Primary Examiner*—J. Travis Brown

*Attorney, Agent, or Firm*—Sughrue, Mion, Zinn, Macpeak, and Seas

[57] ABSTRACT

A method for processing a color photographic light-sensitive material by subjecting an exposed silver halide color photographic light-sensitive material to color development processing then to bleaching and fixing or to bleach-fixing, which method comprises using a ferric ion complex salt or a persulfate as a bleaching agent in the bleaching or bleach-fixing and incorporating at least one compound selected from compounds represented by general formula (I) below and a salt thereof in the bleaching bath or the bleach-fixing bath or in a prebath thereof:

(I)

wherein X represents —COOM, —OH, $—SO_3M$, $—CONH_2$, $—SO_2NH_2$, $—NH_2$, —SH, —CN, $—CO_2R^6$, $—SO_2R^6$, $—OR^6$, $—NR^6R^7$, $—SR^6$, $—SO_3R^6$, $—NHCOR^6$, $—NHSO_2R^6$, $—OCOR^6$ or $—OSO_2R^6$; Y represents or a hydrogen atom; m and n each represents an integer from 1 to 10; $R^1$, $R_2$, $R^4$, $R^5$, $R^7$ and $R^8$ each represents a hydrogen atom or a lower alkyl group; $R^3$ represents a hydrogen atom, a lower alkyl group, an acyl group or $R^6$ represents a lower alkyl group; $R^9$ represents $—NR^{10}R^{11}$, $—OR^{12}$ or $—SR^{12}$; $R^{10}$ and $R^{11}$ each represents a hydrogen atom or a lower alkyl group; $R^{12}$ represents an atomic group necessary to complete a ring by being connected with $R^8$; $R^{10}$ or $R^{11}$ may be connected with $R^8$ to form a ring; and M represents a hydrogen atom or a cation. The method of the present invention does not produce toxic materials which are harmful to the environment and provides an excellent high speed bleaching process without harming photographic properties.

24 Claims, No Drawings

METHOD FOR PROCESSING COLOR PHOTOGRAPHIC LIGHT-SENSITIVE MATERIAL

FIELD OF THE INVENTION

The present invention relates to a method for the processing of an exposed silver halide color photographic light-sensitive material (hereinafter referred to as a color light-sensitive material) which comprises developing, bleaching, and fixing (hereinafter referred to as a color photographic processing method), and, more particularly, to an improved bleaching process which accelerates the bleaching function, thus shortening the processing time while providing sufficient bleaching and providing a color photographic image of good image quality.

BACKGROUND OF THE INVENTION

Fundamental steps of processing color light-sensitive materials generally include a color-developing and a silver removal. Thus, an exposed silver halide color photographic light-sensitive material is introduced into a color-developing step where silver halide is reduced with a color-developing agent to produce silver and the oxidized color developing agent in turn reacts with a color former to yield a dye image. Subsequently, the color photographic material is introduced into a silver removal step where silver produced in the preceding step is oxidized with an oxidizing agent (usually called a bleaching agent) and dissolved away with a silver ion-complexing agent (usually called a fixing agent). Therefore, only a dye image is formed in the thus processed photographic material. In addition to the above two fundamental steps of color development and silver removal, commercial development processing involves auxiliary steps for maintaining the photographic and physical quality of the resulting image or for improving image life. For example, a hardening bath for preventing a light-sensitive layer from being excessively softened during photographic processing, a stopping bath for effectively stopping developing, an image-stabilizing bath for stabilizing the image and a layer-removing bath for removing the backing layer on the support are often used.

The above silver removal may be conducted in two ways: employing a bleaching bath and a fixing bath; a more simple one step procedure employing a bleach-fixing (or blixing) bath containing both a bleaching agent and a fixing agent to accelerate processing and eliminate a process step.

Ferricyanide and ferric chloride, heretofore used as bleaching agents, are good bleaching agents due to their high oxidizing power. However, a bleaching solution or bleach-fixing solution containing ferricyanide as a bleaching agent can release cyanide by photolysis, causing environmental pollution. Accordingly, waste processing solutions thereof must be rendered harmless in view of environmental pollution. A bleaching solution containing ferric chloride as a bleaching agent is not desirable because materials of vessels in which the solution is retained are liable to be corroded due to the extremely low pH and high oxidizing power of the solution. In addition, iron hydroxide is precipitated an in emulsion layer during water-washing after a bleaching step using ferric chloride, resulting in staining.

On the other hand, potassium dichromate, quinones, copper salts, etc., which have been used as bleaching agents, are disadvantageous since they have weak oxidizing power and are difficult to handle.

In recent years, bleach processing using a ferric ion complex salt (e.g., aminopolycarboxylic acid-ferric ion complex salt, particularly iron (III) ethylenediaminetetraacetate complex salt) as a major bleach bath component has mainly been employed in processing color photographic light-sensitive materials in view of the acceleration and simplification of the bleaching provided and the need to prevent environmental pollution.

However, ferric ion complex salts have a comparatively low oxidizing power and, therefore, have insufficient bleaching power. A bleaching or bleach-fixing solution containing such a complex salt as a bleaching agent can attain some desirable objects when bleaching or bleach-fixing a low-speed silver halide color photographic light-sensitive material containing, for example, a silver chlorobromide emulsion as a major component. However, such a solution fails to fully remove silver due to insufficient bleaching power or requires a long time to bleach when processing a high-speed, spectrally sensitized silver halide color photographic light-sensitive material containing a silver chlorobromoiodide emulsion or a silver bromoiodide emulsion as a major component, particularly color reversal light-sensitive materials for photographing or color negative light-sensitive materials comprising an emulsion containing a high amount of silver.

Other known bleaching agents include persulfates. Persulfates are usually used in a bleaching solution together with a chloride. However, a persulfate-containing bleaching solution has lower bleaching power than a ferric ion complex salt, thus requiring a long period of time for bleaching.

As described above, bleaching agents which do not cause environmental pollution or corrode vessels and apparatus have only a weak bleaching power. Hence, there is a need to enhance the bleaching power of a bleaching or bleach-fixing solution containing a weak bleaching agent, particularly a ferric ion ccmplex salt or a persulfate.

In order to raise the bleaching power of a bleaching or bleach-fixing solution containing a ferric ion complex salt such as iron (III) ethylenediaminetetraacetate as a bleaching agent, it has been proposed to add various bleach accelerating agents to the processing bath.

Examples of such bleach accelerating agents include thiourea derivatives as described in Japanese Patent Publication No. 8506/70, U.S. Pat. No. 3,706,561, etc., selenourea derivatives as described in Japanese patent application (OPI) No. 280/71 (the term "OPI" as used herein refers to a "published unexamined Japanese patent application"), 5-membered ring mercapto compounds as described in British Pat. No. 1,138,842, and thiourea derivatives, thiazole derivatives, and thiadiazole derivatives as described in Swiss Pat. No. 336,257. However, many of these bleach accelerating agents do not always show a satisfactory bleach accelerating effect, or some lack stability in the processing solution, although they have a good bleach accelerating effect. Therefore, they provide a processing solution having only a short effective life or which cannot be stored for a long time.

Further, heterocyclic alkylmercaptan derivatives as described in Japanese patent application (OPI) No. 32736/78, aminoalkylmercaptan derivatives as described in U.S. Pat. No. 3,893,858, isothiuronium salt derivatives as described in Japanese patent application (OPI) No. 94927/78 and *Research Disclosure,* RD-15704 (May, 1977), and disulfide derivatives as described in Japanese patent application (OPI) No. 95630/78 and *Research Disclosure,* RD-15704 (May, 1977) are known as bleach accelerating agents. However, these bleach accelerating agents are also disadvantageous since they do not always show a satisfactory bleach accelerating effect or some of them retard fixing (although they accelerate bleaching processing) and thus a long period of time is required for silver removal processing.

SUMMARY OF THE INVENTION

An object of the present invention is to provide a method for processing a color photographic material, which does not release toxic materials, which meets the requirement of preventing environmental pollution and which has excellent bleaching speed.

Another object of the present invention is to provide a method involving a bleaching or bleach-fixing step in which enhanced bleaching power is attained without deteriorating other photographic properties using a bleaching agent having a weak bleaching power, in particular a ferric ion complex salt or a persulfate.

A further object of the present invention is to provide a bleaching process which uses a bleaching or bleach-fixing solution showing increased bleaching speed and having good stability.

A still further object of the present invention is to provide a method which can rapidly bleach or bleach-fix a color photographic light-sensitive material having high photographic speed.

Other objects of the present invention will become apparent from the following description and Examples.

These objects of the present invention are reached by a method for processing a color photographic light-sensitive material comprising subjecting an exposed silver halide color photographic light-sensitive material to color development then to bleaching and to fixing or to bleach-fixing, which method comprises using a ferric ion complex salt or a persulfate as a bleaching agent in the bleaching or bleach-fixing and incorporating at least one compound selected from compounds represented by general formula (I) below and a salt thereof in a bleaching bath or a bleach-fixing bath or in a prebath thereof.

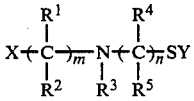

(I)

wherein X represents —COOM, —OH, $—SO_3M$, $—CONH_2$, $—SO_2NH_2$, $—NH_2$, —SH, —CN, $—CO_2R^6$, $—SO_2R^6$, $—OR^6$, $—NR^6R^7$, $—SR^6$, $—SO_3R^6$, $—NHCOR^6$, $—NHSO_2R^6$, $—OCOR^6$ or $—OSO_2R^6$; Y represents

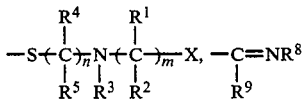

or a hydrogen atom; m and n each represents an integer from 1 to 10; $R^1$, $R^2$, $R^4$, $R^5$, $R^7$ and $R^8$ each represents a hydrogen atom or a lower alkyl group; $R^3$ represents a hydrogen atom, a lower alkyl group, an acyl group or

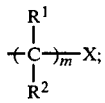

$R^6$ represents a lower alkyl group; $R^9$ represents $—NR^{10}R^{11}$, $—OR^{12}$ or $—SR^{12}$; $R^{10}$ and $R^{11}$ each represents a hydrogen atom or a lower alkyl group; $R^{12}$ represents an atomic group necessary to complete a ring by being connected with $R^8$; $R^{10}$ or $R^{11}$ may be connected with $R^8$ to form a ring; and M represents a hydrogen atom or a cation.

DETAILED DESCRIPTION OF THE INVENTION

The compounds represented by general formula (I) are described in more detail below.

In general formula (I), the integer represented by m or n is preferably an integer from 1 to 4. The acyl group represented by $R^3$ is preferably an acyl group having 5 or less carbon atoms. Examples of the cation represented by M include $Na^+$, $K^+$, $NH_4^+$, etc.

In above general formula (I), the lower alkyl group represented by each of $R^1$ to $R^8$, $R^{10}$ and $R^{11}$ may be substituted and is an alkyl group having 5 or less carbon atoms, and is preferably a methyl group or an ethyl group. Examples of substituents for the lower alkyl group include a carboxyl group, a hydroxyl group, a sulfo group, a carbamoyl group, a sulfamoyl group and an amino group. Further, the ring formed by connecting $R^{10}$ or $R^{11}$ with $R^8$ or formed by connecting $R^{12}$ with $R^8$ may be substituted and examples of the ring include a nitrogen containing 5- or 6-membered hetero ring, for example, an imidazoline ring, a benzimidazole ring, a benzothiazole ring, a benzoxazole ring, a pyrimidine ring, etc.

The compounds represented by general formula (I) used in the present invention are characterized by having the substituent represented by X and due to this substituent the compounds are capable of remarkably accelerating bleaching without retarding fixing. Therefore, it is possible to carry out the silver removal processing in a short period of time.

Specific examples of the compounds or salts thereof represented by general formula (I) are set forth below, but the present invention should not be construed as being limited thereto.

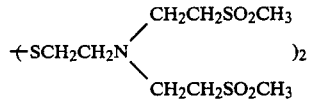

(1)

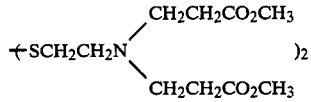

(2)

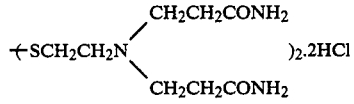

(3)

$(SCH_2CH_2NHCH_2CH_2CH_2SO_3H)_2$ (4)

-continued

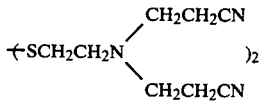
(5)

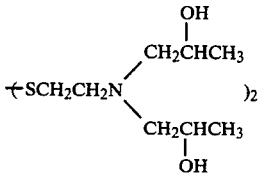
(6)

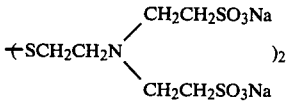
(7)

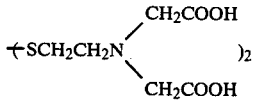
(8)

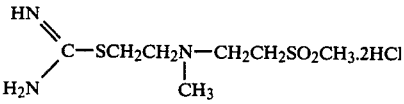
(9)

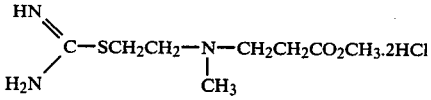
(10)

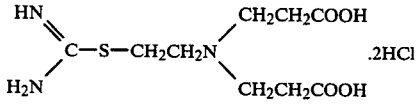
(11)

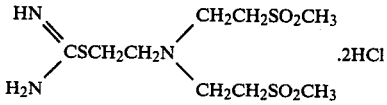
(12)

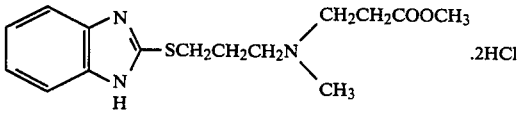
(13)

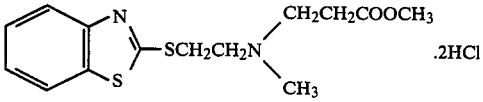
(14)

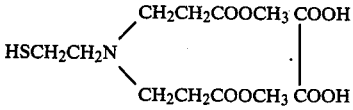
(15)

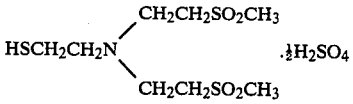
(16)

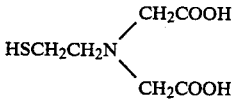
(17)

-continued

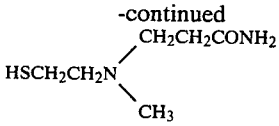
(18)

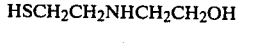
(19)

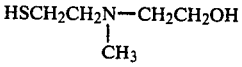
(20)

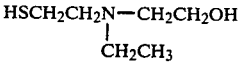
(21)

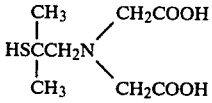
(22)

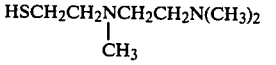
(23)

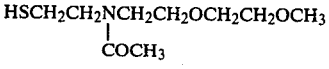
(24)

The compounds represented by general formula (I) described above can be synthesized by methods as described in U.S. Pat. Nos. 3,779,757, 3,341,577 and 3,232,936, G. Schwargenbach et al., *Helv. Chim. Acta.*, Vol. 38, pages 1147 to 1170 (1955), A. F. Ferris et al., *J. Med. Chem.*, Vol. 9, pages 391 to 394 (1966), etc., or the methods as described in the Synthesis Examples hereinbelow.

Specific examples for synthesizing the compounds according to the present invention are set forth below. Unless otherwise indicated, all percents are by weight.

SYNTHESIS EXAMPLE 1

Synthesis of Compound (1)

3.8 g of cystamine and 12.7 g of vinyl methyl sulfone were added to 70 ml of methanol and the mixture was refluxed by heating for 2 days. Then the solvent was distilled off under reduced pressure and the residue obtained was recrystallized from acetone.

Yield: 6.8 g (47 mol %).

Melting Point: 99° to 100° C.

SYNTHESIS EXAMPLE 2

Synthesis of Compound (2)

3.8 g of cystamine was dissolved in 20 ml of methanol and to the solution was added dropwise 9.5 g of methyl acrylate under cooling with ice. After the dropwise addition, the mixture was reacted at 60° C. for 15 hours. The solvent was distilled off under reduced pressure and the residue obtained was purified by column chromatography (stationary phase: silica gel, spreading solvent: methanol/chloroform) to obtain the desired compound as a colorless oil.

Yield: 7.8 g (63 mol %).

SYNTHESIS EXAMPLE 3

Synthesis of Compound (6)

9.2 g of bis(2-p-toluenesulfonyloxyethyl)disulfide obtained by reacting bis(2-hydroxyethyl)disulfide with p-toluenesulfonyl chloride, 8.0 g of diisopropanolamine and 5.4 g of anhydrous potassium carbonate were added to 10 ml of acetone and the mixture was stirred at 43° to 45° C. for 12 hours. After removing insolubles by filtration, the filtrate was concentrated and the residue obtained was purified by column chromatography (stationary phase: silica gel, spreading solvent: methanol/methylene chloride) to obtain the desired compound as a colorless oil.

Yield: 6.2 g (81 mol %).

SYNTHESIS EXAMPLE 4

Synthesis of Compound (9)

10 g of 2-(N-2-methanesulfonylethyl-N-methylamino)ethyl chloride hydrochloride and 3.1 g of thiourea were added to 60 ml of butanol and the mixture was refluxed by heating for 12 hours. The reaction solution was cooled and the crystals obtained were recrystallized from 90% methanol.

Yield: 7.4 g (59 mol %).

Melting Point: 194° to 195° C.

SYNTHESIS EXAMPLE 5

Synthesis of Compound (10)

10.7 g of 2-(N-2-methoxycarbonylethyl-N-methylamino)ethyl chloride hydrochloride and 3.8 g of thiourea were added to 40 ml of butanol and the mixture was refluxed by heating for 5 hours. The solvent was distilled off under reduced pressure and the residue obtained was recrystallized from a solvent mixture of acetone and methanol (1:2 by volume).

Yield: 7 g (48 mol %).

Melting Point: 158° to 159° C. (decomposition).

SYNTHESIS EXAMPLE 6

Synthesis of Compound (12)

11.5 g of N,N-bis(2-methanesulfonylethyl)aminoethyl chloride hydrochloride and 2.7 g of thiourea were added to a mixture of 25 ml of butanol and 2.5 ml of water and the mixture was refluxed by heating for 12 hours. The reaction solution was cooled and the crystals obtained were recrystallized from 90% methanol.

Yield: 9.9 g (70 mol %).

Melting Point: 188° to 190° C.

SYNTHESIS EXAMPLE 7

Synthesis of Compound (15)

To 30 ml of 80% ethanol were added 10 g of Compound (2) obtained in Synthesis Example 2 and 2 g of zinc powder. The suspension was heated to 60° C. to which was added dropwise 8.4 ml of 35% sulfuric acid. After the dropwise addition, the mixture was stirred at 60° C. for 15 minutes and then the reaction solution was filtered while it was hot. The filtrate was neutralized with a 10% aqueous solution of sodium hydroxide and then extracted with chloroform. The organic layers were collected, the solvent was distilled off under reduced pressure and the residue obtained was purified by column chromatography (stationary phase: silica gel, spreading solvent: ethyl acetate/chloroform) to obtain the desired compound as a colorless oil.

Yield: 4.6 g (46 mol %).

Melting Point: 99° to 100° C. (as oxalate).

Further, Compounds (4), (19) to (23) and (17) can be synthesized by the methods or with reference to the methods described in U.S. Pat. Nos. 3,779,757, 3,341,577 and 3,232,936 and G. Schwarzenbach et al., *Helv. Chim. Acta.*, Vol. 38, pages 1147 to 1170 (1955), respectively.

The compounds of the above-described general formula (I) used in the present invention as a bleach accelerating agent may be incorporated in a bleaching bath, a bleach-fixing bath, or a prebath thereof, or may be incorporated in both a bleaching or bleach-fixing bath and a prebath thereof. The amount of the compound of the present invention added to these solutions varies depending upon the kind of processing solution, kind of photographic material to be processed, processing temperature, time necessary for conducting the intended processing, etc. However, an amount of $1\times10^{-5}$ to 1 mol per liter of processing solution is suitable, with $1\times10^{-4}$ to $1\times10^{-1}$ mol being preferable. In general, however, when the amount added is small, there results a small bleach accelerating effect, whereas when the amount is more than is necessary, a precipitate may be formed which stains processed materials. Therefore, the best range is properly determined with consideration for individual cases.

The compound of the present invention is generally added to a processing solution by previously dissolving it in water, an alkali (e.g., sodium hydroxide), an organic acid (e.g., acetic acid or propionic acid), or the like. If necessary, an organic solvent (e.g., methyl alcohol or ethyl alcohol) may be used for dissolving the compound without adversely affecting its bleach accelerating effect.

When incorporating the compound of the present invention in a prebath of a bleaching solution or bleach-fixing solution, the prebath may have various compositions. A prebath having the simplest composition is an aqueous solution prepared by merely dissolving the compound of the present invention in water. Aqueous solutions containing acids such as acetic acid, boric acid, etc., alkalis such as sodium hydroxide, etc., or salts such as sodium sulfite, sodium acetate, sodium thiosulfate, sodium borate, sodium carbonate, sodium bicarbonate, etc., are also usable as prebaths with advantage. Prebaths having any pH may be used with satisfactory effects in the present invention. However, too high a pH may generate stain, and hence prebaths having a pH of 9 or less are generally preferable. The prebath may further contain, if necessary, precipitation-preventing agents comprising various chelate compounds; hardeners comprising various compounds including alums or aldehydes; pH buffers; fixing agents for halides; antioxidants such as sulfites, hydroxylamine, hydrazine, etc.; swelling-preventing agents such as sodium sulfate, magnesium sulfate, etc.; surfactants; and the like.

Between the prebath and the bleaching or bleach-fixing bath there may be provided, for example, a water-washing, a stopping, a stop-fixing, or the like. In such cases, the addition of the compound of the present invention to the prebath will also bring about the same bleach accelerating effect. However, where the compound of the present invention is incorporated only in the prebath, the prebath is preferably provided immediately before a bleaching or bleach-fixing bath.

In the bleaching solution or bleach-fixing solution of the present invention, a bleaching agent with weak bleaching power is used. A ferric ion complex, one useful bleaching agent, is a complex of ferric ion and a chelating agent such as an aminopolycarboxylic acid, an aminopolyphosphonic acid or a salt thereof. Aminopolycarboxylic acid salts or aminopolyphosphonic acid salts are alkali metal salts, ammonium salts or water-soluble amine salts of aminopolycarboxylic acids or aminopolyphosphonic acids. The alkali metals include sodium, potassium, lithium, etc., and water-soluble amines include alkylamines (e.g., methylamine, diethylamine, triethylamine, butylamine, etc.), alicyclic amines (e.g., cyclohexylamine), arylamines (e.g., aniline, m-toluidine, etc.), and heterocyclic amines (e.g., pyridine, morpholine, piperidine, etc.).

Typical examples of these chelating agents, i.e., the aminopolycarboxylic acids, aminopolyphosphonic acids, and salts thereof are:

Ethylenediaminetetraacetic acid,
Disodium ethylenediaminetetraacetate,
Diammonium ethylenediaminetetraacetate,
Tetra(trimethylammonium) ethylenediaminetetraacetate,
Tetrapotassium ethylenediaminetetraacetate,
Tetrasodium ethylenediaminetetraacetate,
Trisodium ethylenediaminetetraacetate,
Diethylenetriaminepentaacetic acid,
Pentasodium diethylenetriaminepentaacetate,
Ethylenediamine-N-(β-hydroxyethyl)-N,N',N'-triacetic acid,
Trisodium ethylenediamine-N-(β-hydroxyethyl)-N,N',N'-triacetate,
Triammonium ethylenediamine-N-(β-hydroxyethyl)-N,N',N'-triacetate,
Propylenediaminetetraacetic acid,
Disodium propylenediaminetetraacetate,
Nitrilotriacetic acid,
Trisodium nitrilotriacetate,
Cyclohexanediaminetetraacetic acid,
Disodium cyclohexanediaminetetraacetate,
Iminodiacetic acid,
Dihydroxyethylglycine,
Ethyl ether diaminetetraacetic acid,
Glycol ether diaminetetraacetic acid,
Ethylenediaminetetrapropionic acid,
Phenylenediaminetetraacetic acid,
1,3-Diaminopropanol-N,N,N',N'-tetramethylenephosphonic acid,
Ethylenediamine-N,N,N',N'-tetramethylenephosphonic acid,
1,3-Propylenediamine-N,N,N',N'-tetramethylenephosphonic acid, etc.

The present invention is not limited to the above-illustrated chelating agents.

The ferric ion complex salts may be used in the form of a complex salt per se or may be formed in situ in solution by using a ferric salt (e.g., ferric sulfate, ferric chloride, ferric nitrate, ferric ammonium sulfate or ferric phosphate) and a chelating agent (e.g., an aminopolycarboxylic acid, aminopolyphosphonic acid or phosphonocarboxylic acid). When they are used in the form of a complex salt, they may be used alone or as a combination of two or more. On the other hand, when a complex is formed in situ in solution by using a ferric salt and a chelating agent, one, two or more ferric salts may be used. Further, one, two or more chelating agents may also be used. In every case, a chelating agent may be used in an excess amount of being necessary for forming a ferric ion complex salt.

A bleaching or bleach-fixing solution containing the above-described ferric ion complex may further contain complexes of metals other than iron such as cobalt or copper or hydrogen peroxide.

Persulfates used in the bleaching or bleach-fixing solution of the present invention include alkali metal persulfates such as potassium persulfate, sodium persulfate, etc., and ammonium persulfate. The bleach accelerating agents of the present invention are, of course, effective for the persulfates, but show particularly remarkable effects on ferric ion complex salts.

The bleaching solution of the present invention can contain re-halogenating agents such as bromides (e.g., potassium bromide, sodium bromide, ammonium bromide, etc.), chlorides (e.g., potassium chloride, sodium chloride, ammonium chloride, etc.), and the like in addition to the bleaching agents such as ferric ion complex salts, etc., and the above-described compounds. Further, additives which have a pH-buffering ability such as inorganic acids, organic acids, or salts thereof which are known to be used in ordinary bleaching solutions (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) may be added.

The amount of bleaching agent is from 0.1 to 2 mols per liter of the bleaching solution, and the pH of the bleaching solution is desirably from 3.0 to 8.0, particularly from 4.0 to 7.0, when a ferric ion complex salt is used. In the case of using a persulfate, the amount of bleaching agent is from 0.02 to 1.0 mol per liter of the bleaching solution, and the pH of the bleaching solution is desirably from 1.5 to 4.

On the other hand, when the compound according to the present invention is employed in a bleach-fixing solution, ordinary fixing agents, i.e., water-soluble, silver halide-dissolving agents such as thiosulfates (e.g., sodium thiosulfate, ammonium thiosulfate, ammonium sodium thiosulfate, potassium thiosulfate, etc.); thiocyanates (e.g., sodium thiocyanate, ammonium thiocyanate, potassium thiocyanate, etc.); thioether compounds (e.g., ethylenebisthioglycolic acid, 3,6-dithia-1,8-octanediol, etc.); and thioureas may be used alone or as a combination of two or more. In addition, a special bleach-fixing solution comprising a combination of a fixing agent as described in Japanese patent application (OPI) No. 155354/80 and 1.7 mols or more of a halide compound such as potassium iodide per liter of the bleach-fixing solution can be used as well.

In the bleach-fixing composition, the ferric ion complex salt is present in an amount of 0.1 to 2 mols and the amount of fixing agent is from 0.2 to 4 mols, per liter of the bleach-fixing solution.

A bleach-fixing solution can contain the aforesaid additives to be added to the bleaching solution and preservatives such as sulfites (e.g., sodium sulfite, potassium sulfite, ammonium sulfite, etc.), hydroxylamine, hydrazine, aldehyde-bisulfite adducts (e.g., acetaldehyde-sodium bisulfite adduct), etc. Further, various fluorescent brightening agents, defoaming agents, surfactants, organic solvents (e.g., methanol), and known bleach-fixing accelerating agents (e.g., polyamine compounds as described in Japanese Patent Publication No. 8836/70, thiourea derivatives as described in Japanese Patent Publication No. 8506/70, iodides as described in German Pat. No. 1,127,715, polyethylene oxides as described in German Pat. No. 966,410, nitrogen-containing heterocyclic compounds as described in German Pat. No. 1,290,812, and other thioureas) may be used. The pH of the bleach-fixing solution upon use is usually from 4.0 to 9.0, particularly preferably from 5.0 to 8.0.

The above bleaching agent or bleaching agent composition can be a bleaching solution for use as is or for use as a replenishing solution and as a preparation for manufacturing a bleaching solution. When two or more liquid preparations are used, the pH of the liquid preparation containing a ferric ion complex salt can be further increased irrespective of the pH range as described above.

Both bleach processing and bleach-fix processing are preferably conducted at temperatures of about 25° to 45° C. for about 30 seconds to 10 minutes. When prebath processing is employed, it is preferably conducted at temperatures of about 25° to 45° C. for 5 minutes or less and at least 1 second.

Primary aromatic amine color developing agents used in the present invention in a color developing solution include a wide range of known developing agents for use in various color photographic processes. The developing agents include aminophenol derivatives and p-phenylenediamine derivatives. These compounds are generally used in the form of salts such as hydrochlorides or sulfates rather than in free form in view of stability advantages. They are generally used in an amount of from about 0.1 g to about 30 g, more preferably from about 1 g to about 15 g, per liter of color developing solution.

The aminophenol type developing agents include, for example, o-aminophenol, p-aminophenol, 5-amino-2-hydroxytoluene, 2-amino-3-hydroxytoluene, 2-hydroxy-3-amino-1,4-dimethylbenzene, etc.

Particularly useful primary aromatic amine type color developing agents are N,N-dialkyl-p-phenylenediamine compounds where the alkyl group and the phenyl group may or may not be substituted. Of these, particularly useful compounds are N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline, 4-amino-N-(2-methoxyethyl)-N-ethyl-3-methylaniline p-toluenesulfonate, etc.

The alkaline color developing solution used in the present invention can optionally contain, in addition to the above-described primary aromatic amine color developing agent, various ingredients usually added to a color developing solution, such as alkali agents (e.g., sodium hydroxide, sodium carbonate, potassium carbonate, etc.), alkali metal sulfites, alkali metal bisulfites, alkali metal thiocyanates, alkali metal halides, benzyl alcohol, water-softening agents, thickening agents, etc. The pH of the color developing solution is usually 7 or above, most generally from about 9 to about 13.

The process of the present invention is applicable to color reversal processing. In the present invention, as a black-and-white developing solution to be used in such processing, a black-and-white first developing solution used for reversal processing of color photographic light-sensitive materials or used for processing black-and-white photographic light-sensitive materials can be used. In addition, various well known additives generally added to a black-and-white developing solution can be incorporated in the solution.

Typical additives include developing agents such as 1-phenyl-3-pyrazolidone, metol, and hydroquinone; preservatives such as sulfites; pH buffers comprising an alkali such as sodium hydroxide, sodium carbonate, or potassium carbonate; inorganic or organic inhibitors such as potassium bromide, 2-methylbenzimidazole, methylbenzothiazole, etc.; water-softening agents such as polyphosphoric acid salts; and slight amounts of development restrainers comprising an iodide or a mercapto compound.

Silver halide color photographic light-sensitive materials processed according to the present invention in the presence of the compound of the present invention are known color photographic light-sensitive materials. The present invention is particularly advantageous for processing coupler-containing multilayer negative color photographic light-sensitive materials or color print photographic light-sensitive materials or for processing color photographic light-sensitive material designed to be subjected to reversal color processing. In addition, color X-ray photographic light-sensitive materials, monolayer special color photographic light-sensitive materials, and color photographic light-sensitive materials containing a black-and-white developing agent such as a 3-pyrazolidone as described in U.S. Pat. Nos. 2,751,297 and 3,902,905 and Japanese Patent Application (OPI) Nos. 64339/81, 85748/81 and 85749/81, and a color developing agent precursor as described in U.S. Pat. Nos. 2,478,400, 3,342,597, 3,342,599, 3,719,492 and 4,214,047 and Japanese Patent Application (OPI) No. 135628/78 can be processed according to the present invention. Further, the processing may be conducted with a coupler in the developing solution.

In a photographic emulsion layer of a color light-sensitive material used in the present invention, any of silver bromide, silver bromoiodide, silver iodochlorobromide, silver chlorobromide, and silver chloride may be used as a silver halide.

During formation or physical ripening of silver halide grains, cadmium salts, zinc salts, lead salts, thallium salts, iridium salts or complex salts thereof, rhodium salts or complex salts thereof, iron salts or complex salts thereof, etc., may be present.

In the present invention, both negative emulsions forming surface latent images and direct reversal emulsions can be used. Examples of the latter emulsions include emulsions forming internal latent images and previously fogged direct reversal emulsions.

The silver halide emulsions used are preferably subjected to chemical sensitization.

That is, sulfur sensitization using sulfur-containing compounds capable of reacting with silver ions or active gelatin, reduction sensitization using a reductive substance, and noble metal sensitization using compounds of noble metals such as gold can be employed alone or in combination. Examples of useful sulfur sensitizers include thiosulfates, thioureas, thiazoles, rhodanines, and other compounds. Examples of useful reduction sensitizers include stannous salts, amines, hydrazine derivatives, formamidinesulfinic acids and silane compounds. For noble metal sensitization, complexes of group VII metals in the Periodic Table such as platinum, iridium, palladium, etc., can be used as well as gold complexes.

The photographic emulsions may be spectrally sensitized with methine dyes or the like. Dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes are cyanine dyes, merocyanine dyes and complex merocyanine dyes.

The light-sensitive material according to the present invention may contain a polyalkylene oxide or an ether, ester or amine derivative thereof, a thioether compound, a thiomorpholine, a quaternary ammonium salt compound, a urethane derivative, a urea derivative, an imidazole derivative, a 3-pyrazolidone, etc., for the purpose of increasing sensitivity or contrast or for accelerating development.

As binders for photographic emulsion layers or other layers, gelatin is advantageously employed, but other hydrophilic colloids may also be used.

Various compounds may be incorporated in the light-sensitive material according to the present invention as antifoggants or stabilizers. That is, many compounds known as antifoggants or stabilizers such as azoles (e.g., benzothiazolium salts, nitroindazoles, triazoles, benzotriazoles, benzimidazoles (particularly, nitro- or halogen-substituted derivatives), etc.); heterocyclic mercapto compounds (e.g., mercaptothiazoles, mercaptobenzothiazoles, mercaptobenzimidazoles, mercaptothiadiazoles, mercaptotetrazoles (particularly, 1-phenyl-5-mercaptotetrazole), and mercaptopyrimidines); heterocyclic mercapto compounds having a water-soluble group such as a carboxyl group or a sulfo group; thioketo compounds (e.g., oxazolinethione); azaindenes (e.g., tetraazaindenes (particularly, 4-hydroxy-substituted (1,3,3a,7)tetraazaindenes)); benzenethiosulfonic acids; benzenesulfinic acids; etc., can be added.

The photographic light-sensitive material according to the present invention may contain an organic or inorganic hardener in its photographic emulsion layers or other layers. For example, chromium salts aldehydes, active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids, etc., can be used alone or in combination.

The photographic light-sensitive material according to the present invention may contain in its photographic emulsion layers or other layers various surfactants for various purposes such as improvement of coating properties, antistatic properties, slipping properties, emulsion dispersibility, anti-adhesion properties, and photographic properties (for example, development acceleration, increase in contrast, sensitization, etc.).

The light-senstiive material according to the present invention contains in its photographic emulsion layers color-forming couplers, that is, compounds capable of forming color by oxidative coupling with an aromatic primary amine developing agent (for example, a phenylenediamine derivative or an aminophenol derivative) in color development processing. For example, magenta couplers include 5-pyrazolone couplers, pyrazolobenzimidazole couplers, cyanoacetylcoumarone couplers, open-chain acylacetonitrile couplers, etc., yellow couplers include acylacetamide couplers (e.g., benzoylacetanilides, pivaloylacetanilides, etc.), and cyan couplers include naphthol couplers, phenol couplers, etc. Of these couplers, nondiffusible couplers having a hydrophobic group called a ballast group are preferred. The couplers may be either 4-equivalent or 2-equivalent to silver ions. Colored couplers having a color-correcting effect or couplers capable of releasing a development inhibitor upon development (so-called DIR couplers) may also be used. In addition to DIR couplers, DIR coupling compounds capable of forming a colorless coupling reaction product and releasing a development inhibitor and DIR redox compounds may also be incorporated.

Particularly preferred couplers include those as described in U.S. Pat. Nos. 4,124,396, 4,327,173, 4,333,999 and 4,334,011 and Japanese Patent Application (OPI) Nos. 155538/82 and 204545/82, etc.

The light-sensitive material according to the present invention can contain a developing agent, including those described in *Research Disclosure,* Vol. 176, page 29 under the item of "Developing Agents".

The light-sensitive material prepared according to the present invention may contain a dye in its photographic emulsion layers or other layers as a filter dye or for various purposes such as prevention of irradiation. Examples of such dyes include those described in *Research Disclosure,* Vol. 176, pages 25 to 27 under the item of "Absorbing and Filter Dyes".

The light-sensitive material according to the present invention can further contain antistatic agents, plasticizers, matting agents, lubricants, ultraviolet ray-absorbing agents, fluorescent brightening agents, air fog-preventing agents, etc.

Silver halide emulsion layers and/or other layers are coated on a support by a procedure such as described in *Research Disclosure,* Vol. 176, pages 27 and 28, under the item of "Coating Procedures".

The compounds according to the present invention have an extremely high bleach accelerating effect and thus it is possible to attain sufficient silver removal in a short processing time even when a bleaching agent with weak bleaching power is used. Also the compounds according to the present invention do not adversely affect photographic properties such as color formation, sensitivity and stain properties. Further, the compounds according to the present invention can stably exist in a processing bath to which they are added for such a long time that problems with control of the bath are decreased.

The present invention will now be described in more detail with reference to the following examples; however, the present invention is not to be construed as being limited thereto. Unless otherwise indicated, all percents are by weight.

EXAMPLE 1

On a triacetyl cellulose support provided with a subbing layer were coated in order the emulsion layers and subsidiary layers as described below.

First Layer: Low Sensitive Red-Sensitive Emulsion Layer 100 g of a cyan coupler, i.e., 2-(heptafluorobutyramido)-5-[2'-(2'',4''-di-tert-amylphenoxy)-butyramido]-phenol was dissolved in 100 ml of tricresyl phosphate and 100 ml of ethyl acetate and stirred at a high speed together with 1 kg of a 10% aqueous gelatin solution to prepare an emulsion. Then, 500 g of the emulsion thus obtained was mixed with 1 kg of a low sensitive red-sensitive silver iodobromide emulsion (containing 70 g of silver and 60 g of gelatin, and having an iodide content of 3 mol %), and the resulting mixture was then coated at a dry thickness of 2 $\mu$(silver coated amount: 0.5 g/m$^2$).

Second Layer: High Sensitive Red-Sensitive Emulsion Layer 100 g of a cyan coupler, i.e., 2-(heptafluorobutyramido)-5-[2'-(2'',4''-di-tert-amylphenoxy)- butyramido]-phenol, was dissolved in 100 ml of tricresyl phosphate and 100 ml of ethyl acetate and stirred at a high speed together with 1 kg of a 10% aqueous gelatin solution to prepare an emulsion. Then, 1,000 g of the emulsion thus obtained was mixed with 1 kg of a high sensitive red-sensitive silver iodobromide emulsion (containing 70 g of silver and 60 g gelatin, and having an iodide content of 3 mol %), and the resulting mixture was then coated at a dry thickness of 2 μ(silver coated amount: 0.8 g/m$^2$).

Third Layer: Intermediate Layer 2,5-Di-tert-octylhydroquinone was dissolved in 100 ml of dibutyl phthalate and 100 ml of ethyl acetate and stirred at a high speed together with 1 kg of a 10% aqueous gelatin solution to prepare an emulsion. Then, 1 kg of the emulsion thus obtained was mixed with 1 kg of a 10% aqueous gelatin solution, and the resulting mixture was coated at a dry thickness of 1 μ.

Fourth Layer: Low Sensitive Green-Sensitive Emulsion Layer

An emulsion was prepared in the same manner as described in the preparation of the emulsion for the first layer except that a magenta coupler, i.e., 1- (2,4,6-trichlorophenyl)-3-[3-(2,4-di-tert-amylphenoxyacetamido)benzamido]-5-pyrazolone, was used in place of the cyan coupler. Then, 500 g of the emulsion thus obtained was mixed with 1 kg of a green-sensitive, low sensitive silver iodobromide emulsion (containing 70 g of silver and 60 g of gelatin, and having an iodine content of 2.5 mol %), and the resulting mixture was coated at a dry thickness of 2.0 μ(silver coated amount: 0.7 g/m$^2$).

Fifth Layer: High Sensitive Green-Sensitive Emulsion Layer

An emulsion was prepared in the same manner as described in the preparation of the emulsion for the first layer except that a magenta coupler, i.e., 1-(2,4,6-trichlorophenyl)-3-[3-(2,4-di-tert-amylphenoxyacetamido)benzamido]-5-pyrazolone, was used in place of the cyan coupler. Then, 1,000 g of the emulsion thus obtained was mixed with 1 kg of a green-sensitive, high sensitive silver iodobromide emulsion (containing 70 g of silver and 60 g of gelatin, and having an iodine content of 2.5 mol %), and the resulting mixture was coated at a dry thickness of 2.0 μ(silver coated amount: 0.7 g/m$^2$).

Sixth Layer: Intermediate Layer 1 kg of the emulsion used in the preparation of the third layer was mixed with 1 kg of a 10% aqueous gelatin solution and coated at a dry thickness of 1 μ.

Seventh Layer: Yellow Filter Layer

An emulsion containing yellow colloidal silver was coated at a dry thickness of 1 μ.

Eighth Layer: Low Sensitive Blue-Sensitive Emulsion Layer

An emulsion was prepared in the same manner as described in the preparation of the emulsion for the first layer except that a yellow coupler, i.e., α-pivaloyl-α-(1-benzyl-5-ethoxy-3-hydantoinyl)-2-chloro-5-dodecyloxycarbonylacetanilide, was used in place of the cyan coupler. Then, 1,000 g of the emulsion thus obtained was mixed with 1 kg of a blue-sensitive, low sensitive silver iodobromide emulsion (containing 70 g of silver and 60 g of gelatin and having an iodine content of 2.5 mol %), and the resulting mixture was coated at a dry thickness of 2.0 μ(silver coated amount: 0.6 g/m$^2$).

Ninth Layer: High Sensitive Blue-Sensitive Emulsion Layer

An emulsion was prepared in the same manner as described in the preparation of the emulsion for the first layer except that a yellow coupler, i.e., α-pivaloyl-α-(1-benzyl- 5-ethoxy-3-hydantoinyl)-2-chloro-5-dodecyloxycarbonylacetanilide, was used in place of the cyan coupler. Then, 1,000 g of the emulsion thus obtained was mixed with 1 kg of a blue-sensitive, high sensitive silver iodobromide emulsion (containing 70 g of gelatin and 60 g of gelatin and having an iodine content of 2.5 mol %), and the resulting mixture was coated at a dry thickness of 2.0 μ(silver coated amount: 1.0 g/m$^2$).

Tenth Layer: Second Protective Layer 1 kg of the emulsion used in the preparation of the third layer was mixed with 1 kg of a 10% aqueous gelatin solution and coated at a dry thickness of 2 μ.

Eleventh Layer: First Protective Layer

A 10% aqueous gelatin solution containing a fine grain silver iodobromide emulsion which had not been chemically sensitized (grain size: 0.15 μ; 1 mol % silver iodobromide emulsion) was coated so that the amount of silver coated was 0.3 g/m$^2$ and the dry thickness was 1 μ.

The color reversal film thus obtained was subjected to exposure at a proper exposure amount to light having a color temperature of 4,800° K. (adjusted using a filter) from a tungsten light source and then to development processing according to the processing steps described below using various bleaching baths containing the compounds according to the present invention.

| Processing Steps | Time (min) | Temperature |
|---|---|---|
| First Developing Bath | 6 | 38° C. |
| Washing with Water | 2 | " |
| Reversal Bath | 2 | " |
| Color Developing Bath | 6 | " |
| Conditioning Bath | 2 | " |
| Bleaching Bath | 5 | " |
| Fixing Bath | 4 | " |
| Washing with Water | 4 | " |
| Stabilizing Bath | 1 | Room Temperature |

The composition of each processing solution used in the above-described processing was as follows.

| | |
|---|---|
| First Developing Bath | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml (pH 10.1) |
| Reversal Bath | |
| Water | 700 ml |
| 6 Na Salt of Nitrilo-N,N,N— | 3 g |

-continued

| | |
|---|---|
| trimethylenephosphonic Acid | |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developing Bath | |
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—β-methanesulfonamidoethyl-3-methyl-4-aminoaniline Sulfate | 11 g |
| Ethylenediamine | 3 g |
| Water to make | 1,000 ml |
| Conditioning Bath | |
| Water | 700 ml |
| Sodium Sulfite | 12 g |
| Sodium Ethylenediaminetetraacetate (dihydrate) | 8 g |
| Glacial Acetic Acid | 3 ml |
| Water to make | 1,000 ml |
| Bleaching Bath | |
| Water | 800 ml |
| Sodium Ethylenediaminetetraacetate (dihydrate) | 2.0 g |
| Iron (III) Ammonium Ethylenediamine-tetraacetate (dihydrate) | 120.0 g |
| Potassium Bromide | 100.0 g |
| Water to make | 1,000 ml |
| Fixing Bath | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| Stabilizing Bath | |
| Water | 800 ml |
| Formalin (37%) | 5.0 ml |
| Fuji Driwel (manufactured by Fuji Photo Film Co., Ltd.) | 5.0 ml |
| Water to make | 1,000 ml |

The silver amount remaining in the maximum density portion of each film sample subjected to the development processing as described above was measured according to X-ray fluorometric analysis. The results thus obtained are shown in Table 1 below.

TABLE 1

| Sample | Bleach Accelerating Agent | Amount Added to Bleaching Bath (mol/l) | Amount of Remaining Silver (μg/cm²) |
|---|---|---|---|
| 1 | Not Added | — | 15 |
| 2 | Compound (1) | $5 \times 10^{-3}$ | 5.4 |
| 3 | Compound (8) | " | 3.2 |
| 4 | Compound (10) | " | 2.7 |
| 5 | Compound (16) | " | 5.1 |
| 6 | Compound (17) | " | 3.0 |

As is apparent from the results shown above, the film samples which were processed in the bleaching bath containing the compound according to the present invention are freed of silver to such a degree that remaining silver does not substantially matter, giving clear color images.

The compounds according to the present invention provided rapid development processing, causing less environmental pollution.

EXAMPLE 2

The same reversal processing as described in Example 1 was conducted except for adding a compound according to the present invention in an amount shown in Table 2 below to the conditioning bath in place of the bleaching bath in the processing in Example 1. The amount of silver remaining in the film samples was determined in the same manner as described in Example 1. The results thus obtained are shown in Table 2 below.

TABLE 2

| Sample | Bleach Accelerating Agent | Amount Added to Conditioning Bath (mol/l) | Amount of Remaining Silver (μg/cm²) |
|---|---|---|---|
| 7 | Not Added | — | 17 |
| 8 | Compound (8) | $1 \times 10^{-2}$ | 4.9 |
| 9 | Compound (10) | " | 4.8 |
| 10 | Compound (16) | " | 5.9 |
| 11 | Compound (17) | " | 3.4 |

As is apparent from the results shown above, the removal of silver is accelerated by the addition of the compound according to the present invention to the conditioning bath to the same degree as when added to the bleaching bath.

EXAMPLE 3

The same reversal processing as described in Example 1 was conducted except for omitting the conditioning bath, providing a bleach-fixing solution having the formulation described below in place of both the bleaching solution and the fixing solution, and adding Compound (8), (9) or (20) according to the present invention to the bleach-fixing solution (bleach-fixing temperature and time: 38° C., 6 minutes) in an amount as shown in Table 3 below. The amount of silver remaining in the film samples was determined in the same manner as described in Example 1. The results thus obtained are shown in Table 3 below.

| Bleach-Fixing Bath | |
|---|---|
| Iron (III) Ammonium Ethylenediamine-tetraacetate Dihydrate | 120.0 g |
| Disodium Ethylenediaminetetraacetate | 5.0 g |
| Ammonium Thiosulfate Aq. Soln. (70%) | 170.0 ml |
| Sodium Sulfite | 10.0 g |
| Water to make | 1,000 ml (pH 6.5) |

TABLE 3

| Sample | Bleach Accelerating Agent | Amount Added to Bleach-Fixing Solution (mol/l) | Amount of Remaining Silver (μg/cm²) |
|---|---|---|---|
| 12 | Not Added | — | 110 |
| 13 | Compound (8) | $5 \times 10^{-3}$ | 4.8 |
| 14 | Compound (9) | " | 3.2 |
| 15 | Compound (20) | " | 4.0 |

As is apparent from the results shown above, the amount of silver remaining in the film samples can be reduced to such a degree that remaining silver does not substantially matter by the addition of the compound according to the present invention to a bleach-fixing bath to the same degree as when the same is added to the bleaching bath or the conditioning bath.

EXAMPLE 4

On a polyethylene terephthalate film support were coated layers having the compositions set forth below to prepare a multilayer color photographic light-sensitive material.

First Laver: Antihalation Layer

A gelatin layer containing black colloidal silver.

Second Layer: Intermediate Layer

A gelatin layer containing a dispersion of 2,5-di-tert-octylhydroquinone

Third Layer: Low Sensitive Red-Sensitive Emulsion Layer

A silver iodobromide emulsion (iodide content 5 mol %), silver coated amount: 1.6 g/m$^2$

| | |
|---|---|
| Sensitizing Dye I | $6 \times 10^{-5}$ mol per mol of silver |
| Sensitizing Dye II | $1.5 \times 10^{-5}$ mol per mol of silver |
| Coupler EX-1 | 0.04 mol per mol of silver |
| Coupler EX-5 | 0.003 mol per mol of silver |
| Coupler EX-6 | 0.0006 mol per mol of silver |

Fourth Layer: High Sensitive Red-Sensitive Emulsion Layer

A silver iodobromide emulsion (iodide content: 10 mol %), silver coated amount: 1.4 g/m$^2$

| | |
|---|---|
| Sensitizing Dye I | $3 \times 10^{-5}$ mol per mol of silver |
| Sensitizing Dye II | $1.2 \times 10^{-5}$ mol per mol of silver |
| Coupler EX-2 | 0.02 mol per mol of silver |
| Coupler EX-5 | 0.0016 mol per mol of silver |

Fifth Layer: Intermediate Layer

Same as the Second Layer

Sixth Layer: Low Sensitive Green-Sensitive Emulsion Layer

A mono-dispersed silver iodobromide emulsion (iodide content: 4 mol %), silver coated amount: 1.2 g/m$^2$

| | |
|---|---|
| Sensitizing Dye III | $3 \times 10^{-5}$ mol per mol of silver |
| Sensitizing dye IV | $1 \times 10^{-5}$ mol per mol of silver |
| Coupler EX-4 | 0.05 mol per mol of silver |
| Coupler EX-8 | 0.008 mol per mol of silver |
| Coupler EX-6 | 0.0015 mol per mol of silver |

Seventh Layer: High Sensitive Green-Sensitive Emulsion Layer

A silver iodobromide emulsion (iodide content: 10 mol %), silver coated amount: 1.3 g/m$^2$

| | |
|---|---|
| Sensitizing Dye III | $2.5 \times 10^{-5}$ mol per mol of silver |
| Sensitizing Dye IV | $0.8 \times 10^{-5}$ mol per mol of silver |
| Coupler EX-3 | 0.017 mol per mol of silver |
| Coupler EX-8 | 0.003 mol per mol of silver |
| Coupler EX-10 | 0.003 mol per mol of silver |

Eighth Layer: Yellow Filter Layer

A gelatin layer containing yellow colloidal silver and a dispersion of 2,5-di-tert-octylhydroquinone

Ninth Layer: Low Sensitive Blue-Sensitive Emulsion Layer

A silver iodobromide emulsion (iodide content: 6 mol %), silver coated amount: 0.7 g/m$^2$

| | |
|---|---|
| Coupler EX-9 | 0.25 mol per mol of silver |
| Coupler EX-6 | 0.015 mol per mol of silver |

Tenth Layer: High Sensitive Blue-Sensitive Emulsion Layer

A silver iodobromide emulsion (iodide content: 6 mol %), silver coated amount: 0.6 g/m$^2$

| | |
|---|---|
| Coupler EX-9 | 0.06 mol per mol of silver |

Eleventh Layer: First Protective Layer

A gelatin layer containing silver iodobromide (iodide content: 1 mol %, average particle size: 0.07 $\mu$), silver coated amount: 0.5 g/m$^2$ and a dispersion of Ultraviolet Ray Absorbing Agent UV-1.

Twelfth Layer: Second Protective Layer

A gelatin layer containing polymethyl methacrylate particles (having a diameter of about 1.5 $\mu$).

Gelatin Hardener H-1 and sodium di(2-ethylhexyl)-sulfosuccinate as a surface active agent were incorporated into each of the layers in addition to the above-described components.

The compounds used for preparing the sample were as follows.

Sensitizing Dye I: Pyridinium salt of anhydro-5,5'-dichloro-3,3'-di(Y-sulfopropyl)-9-ethylthiacarbocyanine hydroxide Sensitizing Dye II: Triethylamine salt of anhydro-9-ethyl-3,3'-di(Y-sulfopropyl)-4,5,4',5'-dibenzothiacarbocyanine hydroxide Sensitizing Dye III: Sodium salt of anhydro-9-ethyl-5,5'-dichloro-3,3'-di(Y-sulfopropyl)oxacarbocyanine Sensitizing Dye IV: Sodium salt of anhydro-5,6,6',6'-tetrachloro-1,1'-diethyl-3,3'-di{$\beta$-[$\beta$-($\gamma$-sulfopropoxy)ethoxy]ethyl}imidazolocarbocyanine hydroxide Coupler EX-1

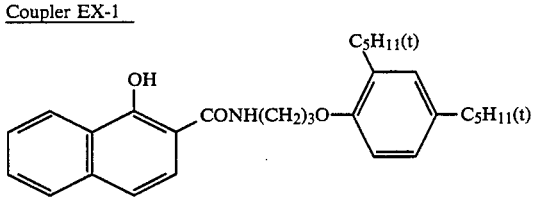

-continued
Coupler EX-2
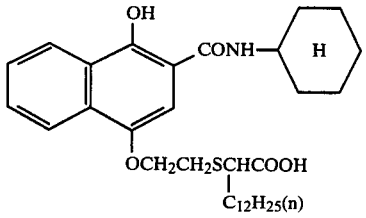
Coupler EX-3
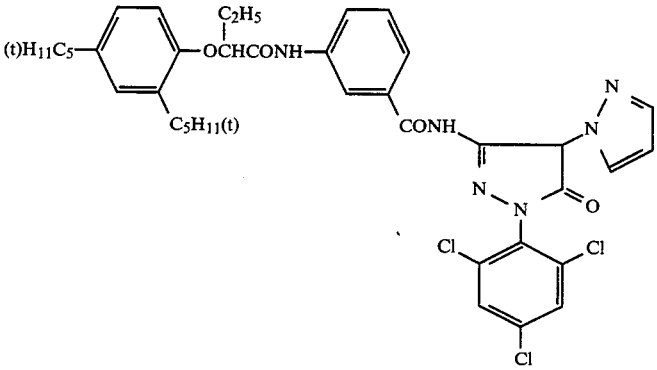
Coupler EX-4
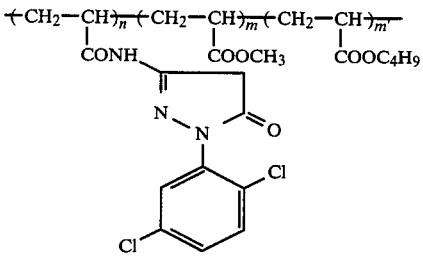
n/m + m' = 1, m/m' = 1 (ratio by weight)
molecular weight: about 40,000
Coupler EX-5
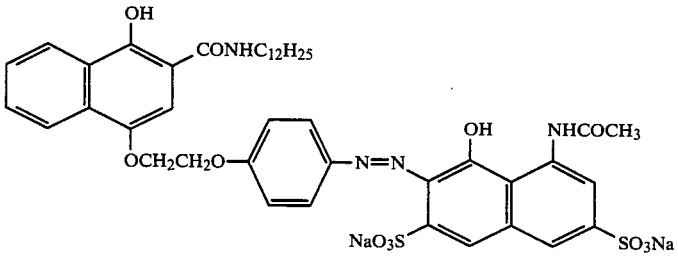
Coupler EX-6
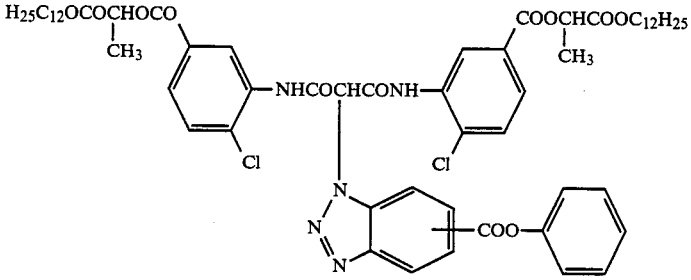
Coupler EX-8

-continued

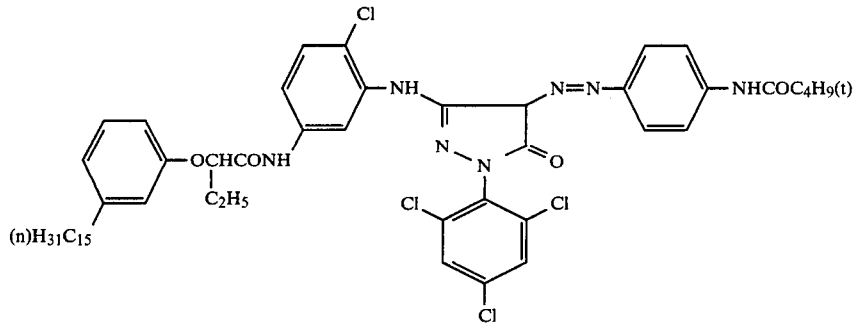

Coupler EX-9

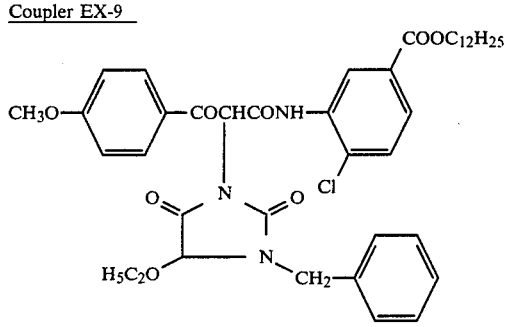

Coupler EX-10

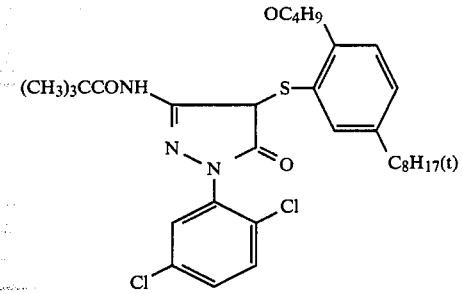

Gelatin Hardener H-1

$CH_2{=}CH{-}SO_2{-}CH_2{-}CONH{-}CH_2{-}CH_2{-}NHCO{-}CH_2{-}SO_2{-}CH{=}CH_2$

Ultraviolet Ray Absorbing Agent UV-1

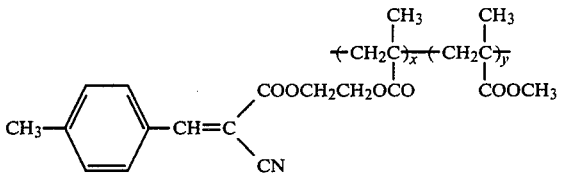

x/y = 7/3 (ratio by weight)

The resulting photographic material was subjected to exposure to light in an exposure amount of 25 CMS using a tungsten light source and a filter to adjust the color temperature to 4,800° K. and then to development processing at 38° C. according to the following processing steps.

| Processing Steps | Time |
|---|---|
| Color Development | 3 min and 15 sec |
| Bleaching | 4 min and 20 sec |
| Fixing | 4 min and 20 sec |
| Washing with Water | 3 min and 15 sec |
| Stabilizing | 30 sec |

The composition of each processing solution used in the above-described processing was as follows.

| Color Developing Solution | |
|---|---|
| Trisodium Nitrilotriacetate | 1.9 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1,000 ml |
| | pH 10.0 |
| **Bleaching Solution** | |
| Iron (III) Ammonium Ethylenediamine-tetraacetate | 80.0 g |

-continued

| | |
|---|---|
| Disodium Ethylenediaminetetraacetate | 8.0 g |
| Ammonium Bromide | 120.0 g |
| Compound According to the Present Invention (shown in Table 4) | Amount shown in Table 4 |
| Water to make | 1,000 ml |
| | pH 6.0 |
| Fixing Solution | |
| Sodium Tetrapolyphosphate | 2.0 g |
| Sodium Sulfite | 4.0 g |
| Ammonium Thiosulfate Aq. Soln. (70%) | 175.0 ml |
| Sodium Bisulfite | 4.6 g |
| Water to make | 1,000 ml |
| | pH 6.6 |
| Stabilizing Solution | |
| Formalin (40%) | 8.0 ml |
| Water to make | 1,000 ml |

The above-described development processing was also conducted as above using the same bleaching bath as described above but not containing the compound according to the present invention.

Each film sample having undergone development processing in the above-described manner was subjected to X-ray fluorometric analysis to determine the silver amount remaining in the maximum density portion of the sample. The results thus obtained are shown in Table 4 below.

TABLE 4

| Sample | Bleach Accelerating Agent | Amount Added to Bleach Bath (mol/l) | Amount of Remaining Silver ($\mu g/cm^2$) |
|---|---|---|---|
| 16 | Not Added | — | 11.7 |
| 17 | Compound (6) | $5 \times 10^{-3}$ | 3.9 |
| 18 | Compound (9) | " | 4.3 |
| 19 | Compound (16) | " | 3.8 |
| 20 | Compound (20) | " | 4.0 |
| 21 | Compound (A) | " | 9.9 |
| 22 | Compound (B) | " | 9.5 |
| 23 | Compound (C) | " | 7.8 |
| 24 | Compound (D) | " | 7.2 |

Compounds (A) to (D) set forth in Table 4 are as follows:

Compound (A)

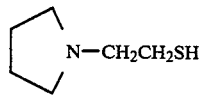

(Described in Japanese Patent Application (OPI) No. 32736/78)

Compound (B)

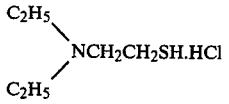

(Described in U.S. Pat. No. 3,893,858)

Compound (C)

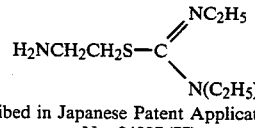

(Described in Japanese Patent Application (OPI) No. 94927/77)

Compound (D)

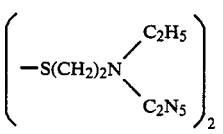

(Described in Japanese Patent Application (OPI) No. 95630/78)

It is apparent from the results shown in Table 4 above that Samples 17 to 20 processed using the compound according to the present invention underwent remarkably accelerated removal of silver in comparison with Comparative Sample 16 processed without the compound according to the present invention and Comparative Samples 21 to 24 processed using known compounds outside the scope of the present invention, and thus highly sensitive negative emulsions can be rapidly bleached and fixed according to the method of the present invention.

EXAMPLE 5

On a polyethylene terephthalate film support having a subbing layer were coated, in sequence, the following emulsion solutions to prepare a color reversal photographic light-sensitive material.

First Layer: Red-Sensitive Emulsion Layer

An emulsion solution prepared by adding to 1,000 g of a silver iodobromide emulsion (silver iodide: 5 mol %) containing 10 g of silver halide and 5 g of gelatin per 100 g of the emulsion 500 g of a gelatin solution containing Cyan Coupler (C-1) emulsified and dispersed therein (molar ratio of silver to coupler=7:1), 50 cc of a 1% aqueous solution of Stabilizer (A-1), 50 cc of a 1% aqueous solution of Coating Agent (T-1), and 20 cc of a 2% aqueous solution of Hardener (H-1) was coated at a dry thickness of 4 $\mu$.

Second Layer: Intermediate Layer

A gelatin solution prepared by adding to 1,000 g of a 5% gelatin aqueous solution 100 g of a gelatin aqueous solution containing Color Mixing Preventing Agent (A-2) emulsified and dispersed therein, 50 cc of a 1% aqueous solution of Coating Agent (T-1), and 20 cc of a 2% aqueous solution of Hardener (H-1) was coated at a dry thickness of 1 $\mu$.

Third Layer: Green-Sensitive Emulsion Layer

An emulsion solution prepared by adding to 1,000 g of a silver iodobromide emulsion (silver iodide: 5 mol %) containing 10 g of silver halide and 5 g of gelatin per 100 g of the emulsion 700 g of a gelatin solution containing Magenta Coupler (C-2) emulsified and dispersed therein (molar ratio of silver to coupler=7:1), 50 cc of a 1% aqueous solution of Stabilizer (A-1), 50 cc of a 1% aqueous solution of Coating Agent (T-1), and 20 cc of a 2% aqueous solution of Hardener (H-1) was coated at a dry thickness of 4 $\mu$.

Fourth Layer: Yellow Filter Layer

A solution prepared by adding 100 cc of a 1% aqueous solution of Coating Agent (T-1) and 20 cc of a 2% aqueous solution of Hardener (H-1) to 1,000 g of a 5% gelatin aqueous solution containing colloidal silver dispersed therein was coated at a silver coated amount of 0.5 mg/100 $cm^2$.

Fifth Layer: Blue-Sensitive Emulsion Layer

An emulsion solution prepared by adding to 1,000 g of a silver iodobromide emulsion (silver iodide: 5 mol %) containing 10 g of silver halide and 5 g of gelatin per 100 g of emulsion 500 g of a gelatin solution containing Yellow Coupler (C-3) emulsified and dispersed therein (molar ratio of silver to coupler=7:1), 50 cc of a 1% aqueous solution of Stabilizer (A-1), 50 cc of a 1% aqueous solution of Coating Agent (T-1), and 20 cc of a 2% aqueous solution of Hardener (H-1) was coated at a dry thickness of 4 μ.

Sixth Layer: Protective Layer

A gelatin solution prepared by adding 100 cc of a 1% aqueous solution of Coating Agent (T-1) and 20 cc of a 1% aqueous solution of Hardener (H-1) to a 5% gelatin aqueous solution was coated in a dry thickness of 1 μ.

Cyan Coupler (C-1)

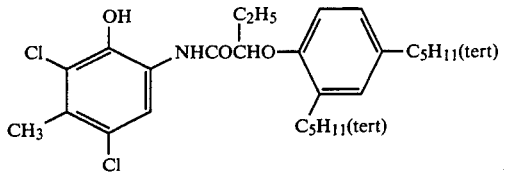

Emulsifying Procedure 75 g of Cyan Coupler (C-1) was dissolved in a solution of 100 cc of dibutyl phthalate and 200 cc of ethyl acetate, and the resulting solution was emulsified in 600 g of a 10% gelatin aqueous solution together with sodium dodecylbenzenesulfonate as a dispersing aid.

Magenta Coupler (C-2)

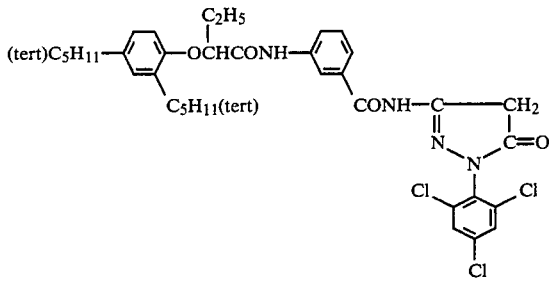

Emulsifying Procedure

Emulsification was conducted in the same manner as for Cyan Coupler (C-1) except for dissolving 75 g of Magenta Coupler (C-2) in place of Cyan Coupler (C-1)

Yellow Coupler (C-3)

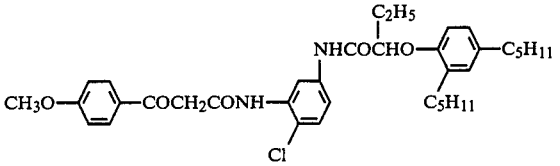

Emulsifying Procedure

Emulsification was conducted in the same manner as for Cyan Coupler (C-1) except for dissolving 90 g of Yellow Coupler (C-3) in place of Cyan Coupler (C-1).

Stabilizer (A-1)

-continued

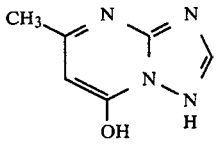

Color Mixing Preventing Agent (A-2)

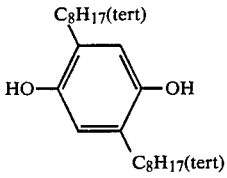

Emulsifying Procedure 100 g of Color Mixing Preventing Agent (A-2) was dissolved in a solution of 200 cc of dibutyl phthalate and 200 cc of ethyl acetate, and the resulting solution was emulsified in 500 g of a 10% gelatin aqueous solution together with sodium dodecylbenzenesulfonate as a dispersing aid.

Coating Agent (T-1)

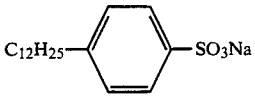

Hardener (H-1)

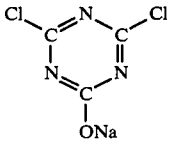

The thus obtained color reversal film sample was exposed in a definite exposure amount, and subjected to development processing according to the following development processing steps using various prebaths containing compounds represented by general formula (I) in an amount shown in Table 5 below, respectively.

| Processing Steps | Temperature (°C.) | Time |
|---|---|---|
| First Development | 43 | 2 min |
| Stopping | 40 | 20 sec |
| Washing with Water | 40 | 40 sec |
| Color Development | 46 | 2 min 15 sec |
| Prebath | 40 | 15 sec |
| Washing with Water | 40 | 5 sec |
| Bleaching | 40 | 45 sec |
| Fixing | 40 | 40 sec |
| Washing with Water | 40 | 25 sec |
| Stabilizing | 40 | 20 sec |

The composition of each processing solution use in the above-described processing is as follows.

| First Developing Solution | |
|---|---|
| Water | 800 ml |
| Quodrafos | 2.0 g |
| Sodium Bisulfite (anhydrous) | 8.00 g |
| Phenidone | 0.35 g |
| Sodium Sulfite (anhydrous) | 37.0 g |

-continued

| | |
|---|---|
| Hydroquinone | 5.50 g |
| Sodium Carbonate (anhydrous) | 28.2 g |
| Sodium Thiocyanate | 1.38 g |
| Sodium Bromide | 1.30 g |
| Potassium Iodide (0.1% aq. soln.) | 13.0 ml |
| Water to make | 1,000 ml |
| | (pH 9.90) |
| Stopping Solution | |
| Water | 800 ml |
| Glacial Acetic Acid | 30.0 ml |
| Sodium Hydroxide | 1.65 g |
| Water to make | 1,000 ml |
| | (pH 3.50) |
| Color Developing Solution | |
| Water | 800 ml |
| Sodium Hexametaphosphate | 5.0 g |
| Benzyl Alcohol | 4.50 ml |
| Sodium Sulfite (anhydrous) | 7.50 g |
| Sodium Tertiary Phosphate (12 hydrate) | 36.0 g |
| Sodium Bromide | 0.90 g |
| Potassium Iodide (0.1% aq. soln.) | 90 ml |
| Sodium Hydroxide | 3.25 g |
| Citrazinic Acid | 1.50 g |
| N—Ethyl-N—β-methanesulfonamidoethyl-3-methyl-4-aminoaniline Sesquisulfate Monohydrate | 11.0 g |
| Ethylenediamine | 3.00 g |
| tert-Butylaminoboran | 0.07 g |
| Water to make | 1,000 ml |
| | (pH 11.65) |
| Prebath | |
| Water | 800 ml |
| Sodium Sulfite (anhydrous) | 12 g |
| Glacial Acetic Acid | 10 ml |
| Bleach Accelerating Agent (shown in Table 5 below) | $1 \times 10^{-2}$ mol |
| Water to make | 1,000 ml |
| pH was adjusted to 3.5 | |
| Bleaching Solution | |
| Water | 800 ml |
| Sodium Persulfate | 60 g |
| Sodium Chloride | 30 g |
| Phosphoric Acid Aqueous Solution (85%) | 11.8 ml |
| Sodium Hydroxide | 6.4 g |
| β-Aminopropionic Acid | 2 g |
| Water to make | 1,000 ml |
| | (pH 2.7) |
| Fixing Solution | |
| Water | 600 ml |
| Ammonium Thiosulfate Aq. Soln. (58%) | 169 ml |
| Sodium Sulfite (anhydrous) | 11.5 g |
| Disodium Ethylenediaminetetraacetate | 0.5 g |
| Sodium Acetate (anhydrous) | 12 g |
| Glacial Acetic Acid | 9 ml |
| Water to make | 1,000 ml |
| | (pH 5.5) |
| Stabilizing Bath | |
| Water | 800 ml |
| Formalin (37.5%) | 6.0 ml |
| Water to make | 1,000 ml |

Each film sample subjected to the development processing in the above-described manner was subjected to X-ray fluorometric analysis to determine the silver amount remaining in the maximum density portion of the sample. The results thus-obtained are shown in Table 5 below.

TABLE 5

| Sample | Bleach Accelerating Agent | Amount Added to Prebath (mol/l) | Amount of Remaining Silver ($\mu g/cm^2$) |
|---|---|---|---|
| 25 | Not Added | — | 450 |
| 26 | Compound (1) | $1 \times 10^{-2}$ | 5 |
| 27 | Compound (4) | " | 8 |

TABLE 5-continued

| Sample | Bleach Accelerating Agent | Amount Added to Prebath (mol/l) | Amount of Remaining Silver ($\mu g/cm^2$) |
|---|---|---|---|
| 28 | Compound (6) | " | 3 |
| 29 | Compound (10) | " | 4 |
| 30 | Compound (15) | " | 7 |
| 31 | Compound (17) | " | 4 |
| 32 | Compound (20) | " | 5 |
| 33 | Compound (23) | " | 6 |
| 34 | Compound (E) | " | 13 |
| 35 | Compound (F) | " | 15 |
| 36 | Compound (G) | " | 21 |

Compounds (E) to (G) set forth in Table 5 are as follows:

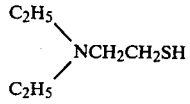
Compound (E)

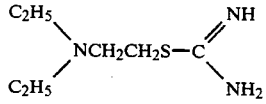
Compound (F)

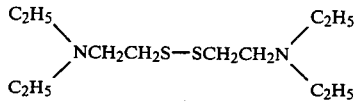
Compound (G)

These compounds are specifically described in or covered by *Research Disclosure,* No. 15704 (1977).

It is apparent from the results shown in Table 5 above that the removal of silver is remarkably accelerated upon the addition of the compound according to the present invention to the prebath of the bleaching solution containing persulfate (see Samples 26 to 33) in comparison with the addition of the comparative compounds (see Samples 34 to 36).

While the invention has been described in detail and with reference to specific embodiments thereof, it will be apparent to one skilled in the art that various changes and modifications can be made therein without departing from the spirit and scope thereof.

What is claimed is:

1. A method for processing a color photographic light-sensitive material by subjecting an exposed silver halide color photographic light-sensitive material to color development then to bleaching and fixing or then to bleach-fixing, which method comprises using a ferric ion complex salt or a persulfate as a bleaching agent in the bleaching or bleach-fixing and incorporating at least one compound selected from compounds represented by general formula (I) below and a salt thereof in a bleaching bath, bleach-fixing bath or in a prebath thereof:

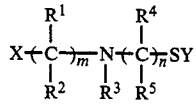
(I)

wherein X represents —COOM, —OH, —$SO_3M$, —$CONH_2$, —$SO_2NH_2$, —$NH_2$, —SH, —CN, —$CO_2R^6$, —$SO_2R^6$, —$OR^6$, —$NR^6R^7$, —$SR^6$, $-SO_3R^6$, $-NHCOR^6$, $-NHSO_2R^6$, $-OCOR^6$ or $-OSO_2R^6$; Y represents

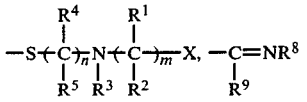

or a hydrogen atom; m and n each represents an integer from 1 to 10; $R^1$, $R^2$, $R^4$, $R^5$, $R^7$ and $R^8$ each represents a hydrogen atom or a lower alkyl group, $R^3$ represents a hydrogen atom, a lower alkyl group, an acyl group or

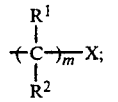

$R^6$ represents a lower alkyl group; $R^9$ represents $-NR^{10}R^{11}$, $-OR^{12}$ or $-SR^{12}$; $R^{10}$ and $R^{11}$ each represents a hydrogen atom or a lower alkyl group; $R^{12}$ represents an atomic group necessary to complete a ring by being connected with $R^8$; $R^{10}$ or $R^{11}$ may be connected with $R^8$ to form a ring; and M represents a hydrogen atom or a cation.

2. A method for processing a color photographic light-sensitive material as claimed in claim 1, wherein the integer represented by m or n is an integer from 1 to 4.

3. A method for processing a color photographic light-sensitive material as claimed in claim 1, wherein the acyl group represented by $R^3$ is an acyl group having 5 or less carbon atoms.

4. A method for processing a color photographic light-sensitive material as claimed in claim 1, wherein the lower alkyl group represented by $R^1$ to $R^8$, $R^{10}$ or $R^{11}$ is an alkyl group having 5 or less carbon atoms.

5. A method for processing a color photographic light-sensitive material as claimed in claim 1, wherein the lower alkyl group represented by $R^1$ to $R^8$, $R^{10}$ or $R^{11}$ is a methyl group or an ethyl group.

6. A method for processing a color photographic light-sensitive material as claimed in claim 1, wherein the ring formed by connecting $R^{10}$ or $R^{11}$ with $R^8$ or formed by connecting $R^{12}$ with $R^8$ is a nitrogen-containing 5 or 6-membered hetero ring.

7. A method for processing a color photographic light-sensitive material as claimed in claim 6, wherein the ring is an imidazoline ring, a benzimidazole ring, a benzothiazole ring, a benzoxazole ring or a pyrimidine ring.

8. A method for processing a color photographic light-sensitive material as claimed in claim 1, wherein the amount of the compound represented by general formula (I) in the bleaching bath, bleach-fixing bath or prebath thereof is from $1\times10^{-5}$ to 1 mol per liter of a processing solution.

9. A method for processing a color photographic light-sensitive material as claimed in claim 1, wherein the compound represented by general formula (I) is incorporated into the bleaching bath or the bleach-fixing bath.

10. A method for processing a color photographic light-sensitive material as claimed in claim 1, wherein the compound represented by general formula (I) is incorporated into the prebath of the bleaching bath or the bleach-fixing bath.

11. A method for processing a color photographic light-sensitive material as claimed in claim 10, wherein the prebath is an aqueous solution containing the compound represented by general formula (I) and having a pH of 9 or less.

12. A method for processing a color photographic light-sensitive material as claimed in claim 10, wherein the prebath is provided immediately before the bleaching or the bleach-fixing bath.

13. A method for processing a color photographic light-sensitive material as claimed in claim 1, wherein the bleaching agent used in the bleaching bath or bleach-fixing bath is a ferric ion complex salt.

14. A method for processing a color photographic light-sensitive material as claimed in claim 13, wherein the ferric ion complex salt is a complex of ferric ion and a chelating agent.

15. A method for processing a color photographic light-sensitive material as claimed in claim 14, wherein the chelating agent is an aminopolycarboxylic acid, an aminopolyphosphonic acid or a salt thereof.

16. A method for processing a color photographic light-sensitive material as claimed in claim 1, wherein the bleaching agent used in the bleaching bath or bleach-fixing bath is a persulfate.

17. A method for processing a color photographic light-sensitive material as claimed in claim 1, wherein the bleaching solution contains a re-halogenating agent.

18. A method for processing a color photographic light-sensitive material as claimed in claim 1, wherein the amount of the bleaching agent is from 0.1 to 2 mols per liter of the bleaching solution.

19. A method for processing a color photographic light-sensitive material as claimed in claim 1, wherein the compound represented by general formula (I) is incorporated into the bleach-fixing solution.

20. A method for processing a color photographic light-sensitive material as claimed in claim 1, wherein the bleach-fixing solution contains a ferric ion complex salt and a fixing agent.

21. A method for processing a color photographic light-sensitive material as claimed in claim 20, wherein the amount of the ferric ion complex salt is from 0.1 to 2 mols and the amount of the fixing agent is from 0.2 to 4 mols, per liter of the bleach-fixing solution.

22. A method for processing a color photographic light-sensitive material as claimed in claim 1, wherein the silver halide color photographic light-sensitive material is a multilayer color photographic light-sensitive material.

23. A method for processing a color photographic light-sensitve material as claimed in claim 1, wherein the compound represented by general formula (I) is selected from the group consisting of:

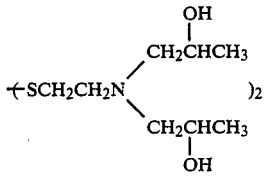

-continued
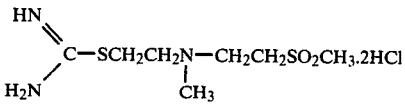
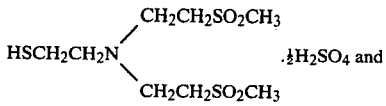
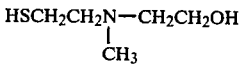
24. A method for processing a color photograhic light-sensitive material as claimed in claim 1, wherein the compound represented by general formula (I) is selected from the group consisting of:
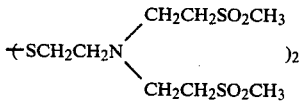
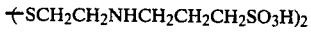
-continued
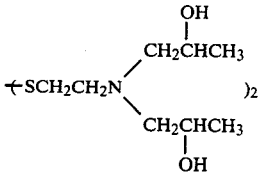
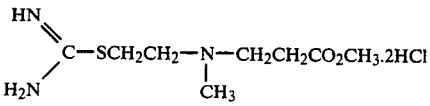
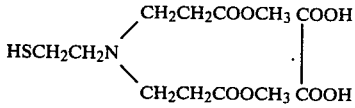
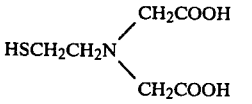
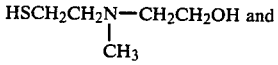
* * * * *